US005864345A

United States Patent [19]

Wickstrom et al.

[11] Patent Number: 5,864,345

[45] Date of Patent: Jan. 26, 1999

[54] TABLE-BASED COLOR CONVERSION TO DIFFERENT RGB16 FORMATS

[75] Inventors: Larry Wickstrom, Portland; Brian R. Nickerson, Aloha, both of Oreg.

[73] Assignee: Intel Corporation, Santa Clara, Calif.

[21] Appl. No.: 654,442

[22] Filed: May 28, 1996

[51] Int. Cl.[6] ..... G09G 1/28

[52] U.S. Cl. ..... 345/431

[58] Field of Search ..... 345/112, 153, 345/433, 430, 431

[56] References Cited

U.S. PATENT DOCUMENTS

| | | | |
|---|---|---|---|
| 4,743,959 | 5/1988 | Frederiksen . | |
| 4,775,858 | 10/1988 | Stapleton et al. . | |
| 4,857,992 | 8/1989 | Richards . | |
| 4,991,122 | 2/1991 | Sanders . | |
| 5,068,644 | 11/1991 | Batson et al. . | |
| 5,124,688 | 6/1992 | Rumball . | |
| 5,138,303 | 8/1992 | Rupel . | |
| 5,142,273 | 8/1992 | Wobermin . | |
| 5,204,664 | 4/1993 | Hamekawa . | |
| 5,218,431 | 6/1993 | Gleicher et al. . | |
| 5,218,432 | 6/1993 | Wakeland . | |
| 5,220,410 | 6/1993 | Wakeland et al. . | |
| 5,233,684 | 8/1993 | Ulichney . | |
| 5,258,826 | 11/1993 | Wakeland et al. . | |
| 5,341,442 | 8/1994 | Barrett . | |
| 5,381,180 | 1/1995 | Keith . | |
| 5,384,582 | 1/1995 | Keith et al. . | |
| 5,406,310 | 4/1995 | Aschenbrenner et al. . | |
| 5,416,614 | 5/1995 | Crawford . | |
| 5,428,465 | 6/1995 | Kanamori et al. . | |
| 5,428,720 | 6/1995 | Adams, Jr. . | |
| 5,430,465 | 7/1995 | Sabella et al. . | |
| 5,450,098 | 9/1995 | Oz . | |
| 5,510,852 | 4/1996 | Shyu . | |
| 5,572,232 | 11/1996 | Rhodes et al. | 345/431 X |
| 5,611,028 | 3/1997 | Shibasaki et al. | 345/431 |
| 5,649,083 | 7/1997 | Barkans et al. | 345/431 |
| 5,652,601 | 7/1997 | Coeltto et al. | 345/433 X |

OTHER PUBLICATIONS

IBM Technical Disclosure Bulletin, vol. 37, No. 03, Mar. 1994 New York, US, pp. 95–96, XP 000441392 'Direct–to–Palette Dithering.'.

IBM Technical Disclosure Bulletin, vol. 33, No. 5, Oct. 1990 New York, US, pp. 200–205, XP 000107434 'Default RGB Color Palette with Simple Conversion from YUV.'.

IEEE Transactions on Consumer Electronics, vol. 37, Issue 3, Aug. 1991, pp. 182–189, "Single–Chip Video Processing System," by Hans–Jürgen Désor.

*Primary Examiner*—Cliff N. Vo

*Attorney, Agent, or Firm*—William H. Murray, Esq.

[57] ABSTRACT

Image data in an initial color format (e.g., subsampled YUV9 data) is color converted to a selected RGB16 color format by executing compiled computer program code. The same compiled computer program code can be used to convert the image data in the initial color format into image data in any of two or more different RGB16 formats. In a preferred embodiment, lookup tables (configurable during run-time processing) are used to make the color conversion processing more efficient. The selected RGB16 color format can be changed during run-time processing, in which case certain lookup tables are reinitialized for the newly selected RGB16 format.

40 Claims, 5 Drawing Sheets

TABLE-BASED COLOR CONVERSION TO DIFFERENT RGB16 FORMATS

BACKGROUND OF THE INVENTION

1. Field of the Invention

The present invention relates to computer-based image processing, and, in particular, to converting image data from one color format to another color format.

2. Description of the Related Art

Many computer-based video processing systems encode video data to reduce the number of bits used to represent sequences of video images for more efficient storage and/or transmission. It has been found that converting the video data to a three-component YUV color format can improve the degree of compression attainable for a given sequence of video images. Nevertheless, most computer display subsystems rely on image data being in a three-component RGB color format. An integrated computer system that decodes encoded YUV image data for display on an RGB-based display subsystem typically converts the decoded YUV image data to displayable RGB image data.

The present invention is directed to an efficient procedure for converting image data from an initial color format, such as a YUV format, into image data in an RGB color format.

Further objects and advantages of this invention will become apparent from the detailed description of a preferred embodiment which follows.

SUMMARY OF THE INVENTION

The present invention is directed to the color conversion of image data. According to a preferred embodiment, image data is provided in an initial color format. Compiled computer program code is executed to convert the image data in the initial color format into image data in one of two or more different RGB16 formats, wherein the same compiled computer program code can be used to convert the image data in the initial color format into image data in any of the two or more different RGB16 formats.

BRIEF DESCRIPTION OF THE DRAWINGS

Other objects, features, and advantages of the present invention will become more fully apparent from the following detailed description of the preferred embodiment, the appended claims, and the accompanying drawings in which:

DESCRIPTION OF THE PREFERRED EMBODIMENT(S)

The present invention is directed to an efficient method for converting image data from an initial color format (e.g., subsampled YUV9 data) into a selected RGB16 color format. In a preferred embodiment, the color conversion is implemented by executing compiled computer program code that accesses lookup tables. The lookup tables, which are configurable during run-time processing, are designed for the selected RGB16 color format. The same compiled computer program code can be executed for any of the different supported RGB16 color formats with only certain of the lookup tables being reinitialized when the selection of color format is changed during run-time processing.

System Hardware Architectures

Figure 1:
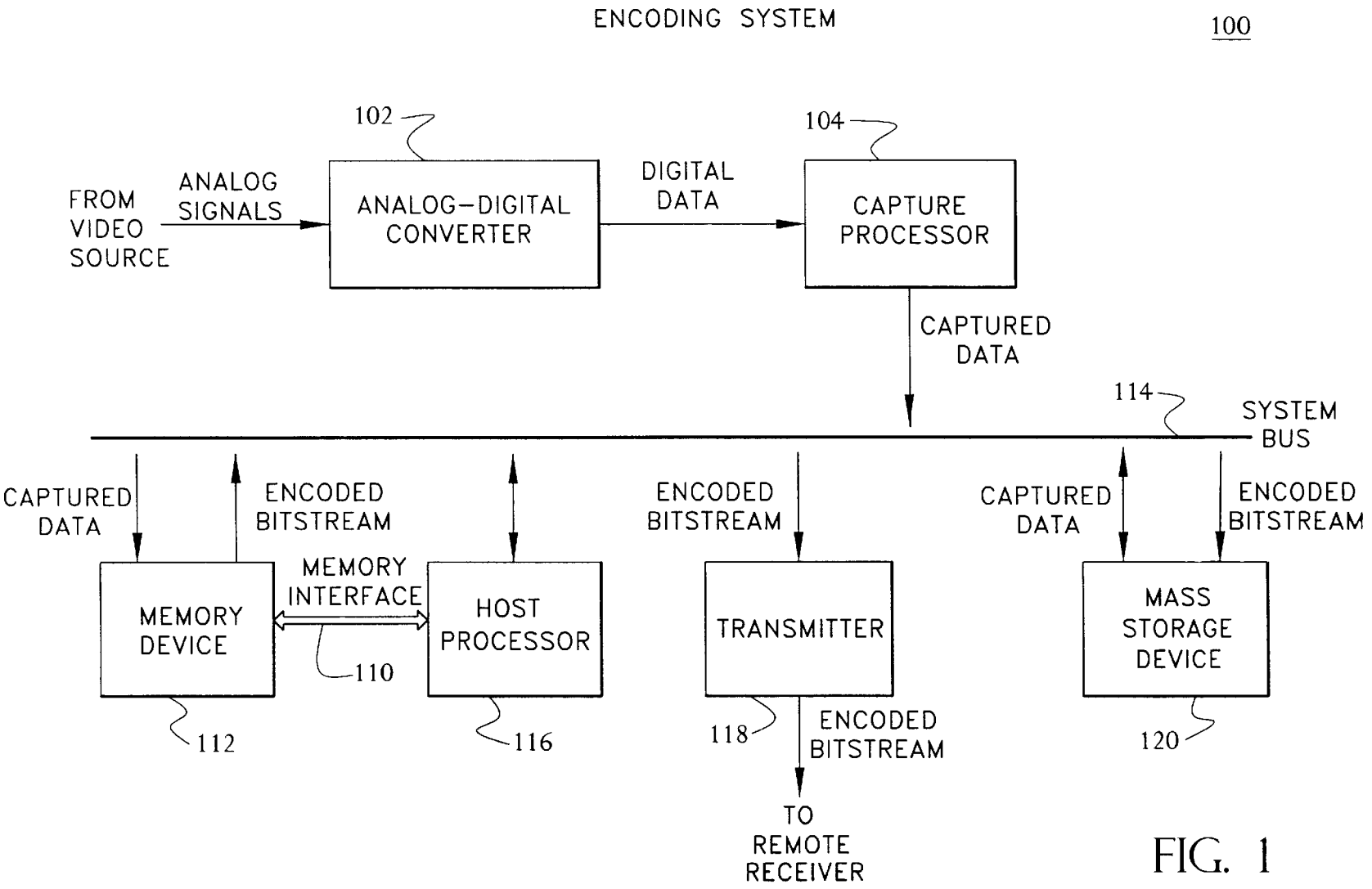
FIG. 1 is a block diagram of a computer system for encoding video signals, according to a preferred embodiment of the present invention.

Referring now to FIG. 1, there is shown a block diagram of computer system 100 for encoding video signals, according to a preferred embodiment of the present invention. Analog-to-digital (A/D) converter 102 of encoding system 100 receives analog video signals from a video source. The video source may be any suitable source of analog video signals such as a video camera or VCR for generating local analog video signals or a video cable or antenna for receiving analog video signals from a remote source. A/D converter 102 separates the analog video signal into constituent components and digitizes the analog components into digital video component data (e.g., in one embodiment, 24-bit RGB component data).

Capture processor 104 captures the digital 3-component video data received from converter 102. Capturing may include one or more of color conversion (e.g., RGB to YUV), scaling, and subsampling. Each captured video frame is represented by a set of three two-dimensional component planes, one for each component of the digital video data. In one embodiment, capture processor 104 captures video data in a YUV9 (i.e., YUV 4:1:1) format, in which every (4×4) block of pixels of the Y-component plane corresponds to a single pixel in the U-component plane and a single pixel in the V-component plane. Capture processor 104 selectively stores the captured data to memory device 112 and/or mass storage device 120 via system bus 114. Those skilled in the art will understand that, for real-time encoding, the captured data are preferably stored to memory device 112, while for non-real-time encoding, the captured data are preferably stored to mass storage device 120. For non-real-time encoding, the captured data will subsequently be retrieved from mass storage device 120 and stored in memory device 112 for encode processing by host processor 116.

During encoding, host processor 116 reads the captured bitmaps from memory device 112 via high-speed memory interface 110 and generates an encoded video bitstream that represents the captured video data. Depending upon the particular encoding scheme implemented, host processor 116 applies a sequence of compression steps to reduce the amount of data used to represent the information in the video images. The resulting encoded video bitstream is then stored to memory device 112 via memory interface 110. Host processor 116 may copy the encoded video bitstream to mass storage device 120 for future playback and/or transmit the encoded video bitstream to transmitter 118 for real-time transmission to a remote receiver (not shown in FIG. 1).

Figure 2:
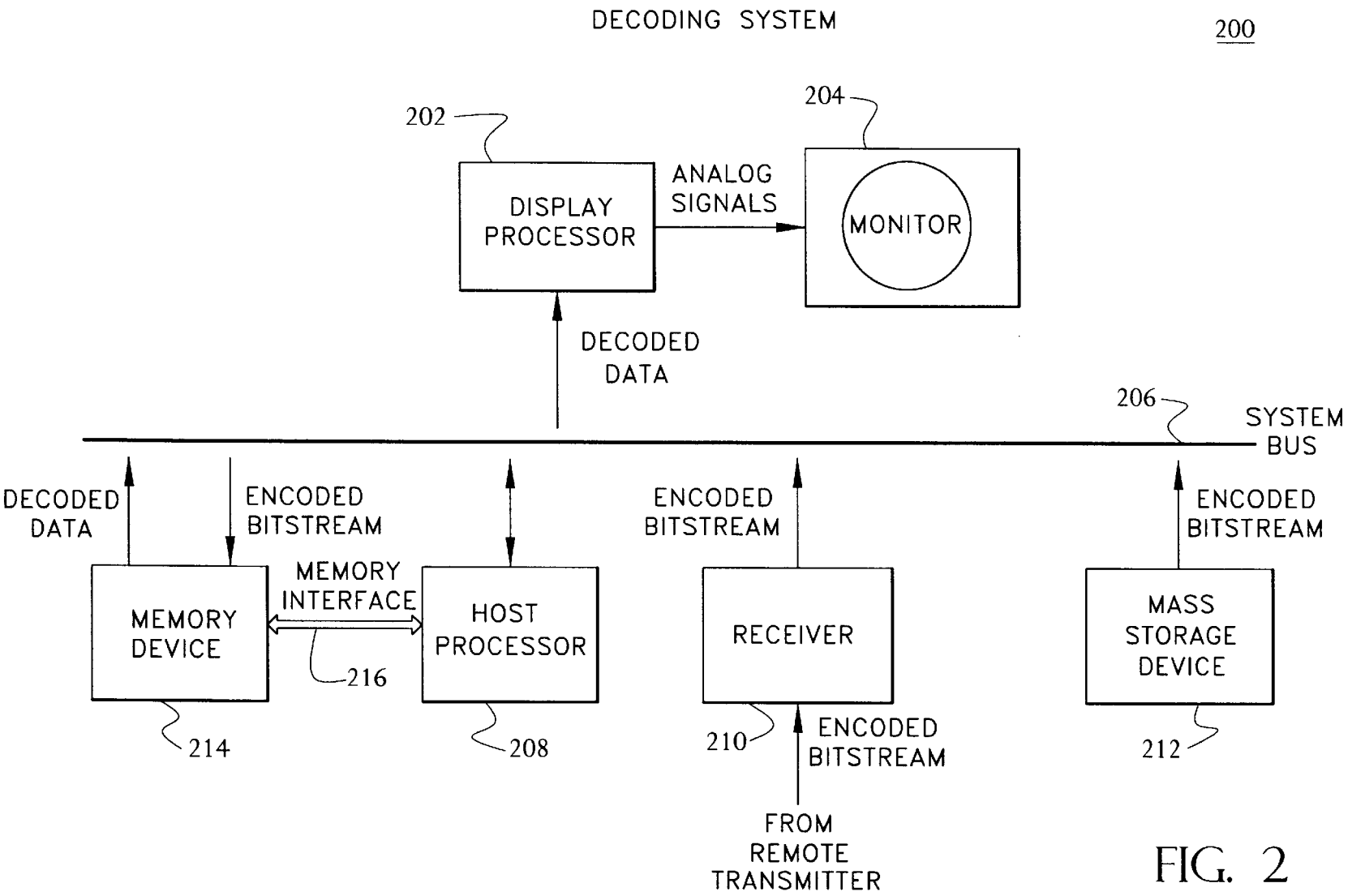
FIG. 2 is a block diagram of a computer system for decoding the video signals generated by the computer system of FIG. 1, according to a preferred embodiment of the present invention.

Referring now to FIG. 2, there is shown a block diagram of computer system 200 for decoding the encoded video bitstream generated by encoding system 100 of FIG. 1, according to a preferred embodiment of the present invention. The encoded video bitstream is either read from mass storage device 212 of decoding system 200 or received by receiver 210 from a remote transmitter, such as transmitter 118 of FIG. 1. The encoded video bitstream is stored to memory device 214 via system bus 206.

Host processor 208 accesses the encoded video bitstream stored in memory device 214 via high-speed memory interface 216 and decodes the encoded video bitstream for display. Decoding the encoded video bitstream involves undoing the compression processing implemented by encoding system 100 of FIG. 1. Host processor 208 stores the resulting decoded video data to memory device 214 via memory interface 216 from where the decoded video data are transmitted to display processor 202 via system bus 206. Alternatively, host processor 208 transmits the decoded video data directly to display processor 202 via system bus 206. Display processor 202 processes the decoded video data for display on monitor 204. The processing of display processor 202 includes digital-to-analog conversion of the decoded video data. After being decoded by host processor 208 but before being D/A converted by display processor 202, the decoded video data may be upsampled (e.g., from YUV9 to YUV24), scaled, and/or color converted (e.g., from YUV24 to RGB16). Depending upon the particular embodiment, each of these processing steps may be implemented by either host processor 208 or display processor 202. In a preferred embodiment, the video data is converted from subsampled YUV9 data directly to an RGB16 color format, as described in the next section of this specification. The video data may be further processed in the RGB16 color format (e.g., combined with graphics or other video data and/or further converted to a color lookup table (CLUT) format) before being converted to the RGB24 color format for display.

Referring again to FIG. 1, encoding system 100 is preferably a microprocessor-based personal computer (PC) system with a special purpose video-processing plug-in board. In particular, A/D converter 102 may be any suitable means for decoding and digitizing analog video signals. Capture processor 104 may be any suitable processor for capturing digital video component data as subsampled frames. In a preferred embodiment, A/D converter 102 and capture processor 104 are contained in a single plug-in board capable of being added to a microprocessor-based PC system.

Host processor 116 may be any suitable means for controlling the operations of the special-purpose video processing board and for performing video encoding. Host processor 116 is preferably a general-purpose microprocessor manufactured by Intel Corporation, such as an i486™, Pentium®, or Pentium® Pro processor. System bus 114 may be any suitable digital signal transfer device and is preferably a peripheral component interconnect (PCI) bus. Memory device 112 may be any suitable computer memory device and is preferably one or more dynamic random access memory (DRAM) devices. High-speed memory interface 110 may be any suitable means for interfacing between memory device 112 and host processor 116. Mass storage device 120 may be any suitable means for storing digital data and is preferably a computer hard drive. Transmitter 118 may be any suitable means for transmitting digital data to a remote receiver. Those skilled in the art will understand that the encoded video bitstream may be transmitted using any suitable means of transmission such as telephone line, RF antenna, local area network, or wide area network.

Referring again to FIG. 2, decoding system 200 is preferably a microprocessor-based PC system similar to the basic PC system of encoding system 100. In particular, host processor 208 may be any suitable means for decoding an encoded video bitstream and is preferably a general purpose microprocessor manufactured by Intel Corporation, such as an i486™, Pentium®, or Pentium® Pro processor. System bus 206 may be any suitable digital data transfer device and is preferably a PCI bus. Mass storage device 212 may be any suitable means for storing digital data and is preferably a CD-ROM device or a hard drive. Receiver 210 may be any suitable means for receiving the digital data transmitted by transmitter 118 of encoding system 100. Display processor 202 and monitor 204 may be any suitable devices for processing and displaying video images (including the conversion of digital video data to analog video signals) and are preferably parts of a PC-based display system having a PCI graphics board and a 24-bit RGB monitor.

In a preferred embodiment, encoding system 100 of FIG. 1 and decoding system 200 of FIG. 2 are two distinct computer systems. In an alternative preferred embodiment of the present invention, a single computer system comprising all of the different components of systems 100 and 200 may be used to encode and decode video images. Those skilled in the art will understand that such a combined system may be used to display decoded video images in real-time to monitor the capture and encoding of video stream.

In alternative embodiments of present invention, the video encode processing of an encoding system and/or the video decode processing of a decoding system may be assisted by a pixel processor or other suitable component(s) to off-load processing from the host processor by performing computationally intensive operations.

Color Conversion

In a preferred embodiment of the present invention, host processor 208 of decoding system 200 of FIG. 1 generates (as part of the video decoding process) image data in a subsampled YUV9 color format and converts that image data to a specified RGB16 color format. Those skilled in the art understand that there are several different standard RGB16 color formats. Standard RGB16 formats include RGB555, RGB565, RGB664, and RGB655 formats. The present invention also supports other (possibly non-standard) RGB16 color formats, including RGB556, RGB646, and RGB466 formats.

In general, the nomenclature "RGBxyz" refers to a color format in which each pixel is represented by a computer data word (i.e., two 8-bit bytes of data) consisting of x bits of red component (R), y bits of green component (G), and z bits of blue component (B). For example, each pixel of image data in the RGB565 color format may be represented by the following two-byte word pattern:

$$RGB565=(r1\ r2\ r3\ r4\ r5\ g1\ g2\ g3\ g4\ g5\ g6\ b1\ b2\ b3\ b4\ b5) \quad (1)$$

where the 5 R-component bits appear as the most significant bits (MSBs) of the upper byte of the 16-bit word, the 6 G-component bits are split evenly between the least significant bits (LSBs) of the upper byte and the MSBs of the lower byte, and the 5 B-component bits appear as the LSBs of the lower byte.

This is different, for example, from the two-byte word pattern for image data in the RGB664 color format, which may be represented as follows:

$$RGB664=(r1\ r2\ r3\ r4\ r5\ r6\ g1\ g2\ g3\ g4\ g5\ g6\ b1\ b2\ b3\ b4) \quad (2)$$

and both are different from the two-byte word pattern for image data in the RGB555 format, which may be represented as follows:

$$RGB555=(\alpha r1\ r2\ r3\ r4\ r5\ g1\ g2\ g3\ g4\ g5\ b1\ b2\ b3\ b4\ b5) \quad (3)$$

The RGB555 format has an extra bit ($\alpha$ in Equation (3)) that may be left unused or used, for example, as an alpha-channel transparency bit for applications such as chromakeying.

In general, the conversion of image data from YUV color space to RGB color space may be represented by the following matrix Equation (4):

$$\begin{bmatrix} R \\ G \\ B \end{bmatrix} = \begin{bmatrix} a & b & c \\ d & e & f \\ g & h & i \end{bmatrix} \begin{bmatrix} Y-16 \\ U-128 \\ V-128 \end{bmatrix} \tag{4}$$

where:

$$\begin{bmatrix} a & b & c \\ d & e & f \\ g & h & i \end{bmatrix} = \begin{bmatrix} 1.164 & -0.001 & 1.596 \\ 1.164 & -0.391 & -0.813 \\ 1.164 & 2.017 & 0.001 \end{bmatrix} \tag{5}$$

Since b and i have negligible impact to the calculation, they can be treated as zero. This YUV-to-RGB color transformation can then be approximated by Equations (6)–(8) as follows:

$$R=j*(Y+k*V) \tag{6}$$

$$G=j*(Y+l*U+m*V) \tag{7}$$

$$B=j*(Y+n*U) \tag{8}$$

where:

$$j=a=d=g=1.164 \tag{9}$$

$$k=c/j=1.371 \tag{10}$$

$$l=e/j=-0.336 \tag{11}$$

$$m=f/j=-0.698 \tag{12}$$

$$n=h/j=1.733 \tag{13}$$

According to a preferred embodiment, an intermediate contribution from the V component to the R component is labeled "RV" and corresponds to the product of k and V in Equation (6). Similarly, an intermediate contribution from the U component to the G component is labeled "GU", and corresponds to the product of l and U in Equation (7), an intermediate contribution from the V component to the G component is labeled "GV" and corresponds to the product of m and V in Equation (7); and an intermediate contribution from the U component to the B component is labeled "BU" and corresponds to the product of n and U in Equation (8).

In a preferred embodiment of the present invention, the intermediate contributions RV, GU, GV, and BU are generated using lookup tables (labeled Table_kV, Table_lU, Table_mV, and Table_nU, respectively) that map the U or V component to the appropriate product. That is, for example, accessing Table-kV using the V component as a table index yields a table entry RV corresponding to the product of k and V. The four intermediate contributions RV, GU, GV, and BU may be represented by Equations (14)–(17) as follows:

$$RV=\text{Table_kV}[V] \tag{14}$$

$$GU=\text{Table_}lU[U] \tag{15}$$

$$GV=\text{Table_}mV[V] \tag{16}$$

$$BU=\text{Table_}nU[U] \tag{17}$$

Those skilled in the art will understand that these table lookups are used to increase the speed of processing over other procedures that perform the relatively slow multiplications during run-time processing.

These intermediate contributions RV, GU, GV, and BU are then used to generate indices for a second stage of lookup tables that map to the final R, G, and B components. These table lookups may be represented as Equations (18)–(20) as follows:

$$R=R\text{table}[Y+RV+d_r] \tag{18}$$

$$G=G\text{table}[Y+GU+GV+d_g] \tag{19}$$

$$B=B\text{table}[Y+BU+d_b] \tag{20}$$

where Y is the pixel Y component; $d_r$, $d_g$, and $d_b$ are dither contributions; and Rtable, Gtable, and Btable are lookup tables that map from the indices shown in brackets in Equations (18)–(20) to the R, G, and B components, respectively. The lookup tables Rtable, Gtable, and Btable map each index to the product of j and the index as shown in Equations (6)–(8), respectively. Those skilled in the art will understand that dither contributions are used to decrease contouring in the decoded images.

In order to generate RGB16 data in the appropriate format, the lookup tables Rtable, Gtable, and Btable are designed such that their table entries are appropriately spaced for efficient combination into the appropriate two-byte word format of the selected RGB16 color format. For example, when RGB664 is the selected RGB16 color format, the lookup tables return 8-bit byte data for the RGB664 components $R_{664}$, $G_{664}$, and $B_{664}$ according to the following bit patterns:

$$R_{664}=\text{Rtable_}\mathbf{664}[\text{Index}]=(\text{r}\mathbf{1}\ \text{r}\mathbf{2}\ \text{r}\mathbf{3}\ \text{r}\mathbf{4}\ \text{r}\mathbf{5}\ \text{r}\mathbf{6}\ 0\ 0) \tag{21}$$

$$G_{664}=\text{Gtable_}\mathbf{664}[\text{Index}]=(0\ 0\ \text{g}\mathbf{1}\ \text{g}\mathbf{2}\ \text{g}\mathbf{3}\ \text{g}\mathbf{4}\ \text{g}\mathbf{5}\ \text{g}\mathbf{6}) \tag{22}$$

$$B_{664}=\text{Btable_}\mathbf{664}[\text{Index}]=(0\ 0\ 0\ 0\ \text{b}\mathbf{1}\ \text{b}\mathbf{2}\ \text{b}\mathbf{3}\ \text{b}\mathbf{4}) \tag{23}$$

In order to combine these components into the two-byte word format for the RGB664 format of Equation (2), the RGB components may be manipulated by executing compiled computer program code corresponding to the following pseudocode:

| | |
|---|---|
| Store G component into lower byte of empty two-byte register. | // Step (a) |
| Shift two-byte register four bits left. | // Step (b) |
| OR R component into upper byte of two-byte register. | // Step (c) |
| OR B component into lower byte of two-byte register. | // Step (d) |

For RGB664 data, the status of the two-byte register after each of steps (a) through (d) is shown as follows:

| | | | | | | | | | | | | | | | | | | |
|---|---|---|---|---|---|---|---|---|---|---|---|---|---|---|---|---|---|---|
| Step (a): | ( | 0 | 0 | 0 | 0 | 0 | 0 | 0 | 0 | 0 | 0 | g1 | g2 | g3 | g4 | g5 | g6 | ) |
| Step (b): | ( | 0 | 0 | 0 | 0 | 0 | 0 | g1 | g2 | g3 | g4 | g5 | g6 | 0 | 0 | 0 | 0 | ) |
| Step (c): | ( | r1 | r2 | r3 | r4 | r5 | r6 | g1 | g2 | g3 | g4 | g5 | g6 | 0 | 0 | 0 | 0 | ) |
| Step (d): | ( | r1 | r2 | r3 | r4 | r5 | r6 | g1 | g2 | g3 | g4 | g5 | g6 | b1 | b2 | b3 | b4 | ) |

When RGB565 is the selected RGB16 color format, a different set of lookup tables is preferably used which return 8-bit byte data for the RGB565 components $R_{565}$, $G_{565}$, and $B_{565}$ according to the following bit patterns:

$$R_{565}=\text{Rtable_}\mathbf{565}[\text{Index}]=(\text{r}\mathbf{1}\ \text{r}\mathbf{2}\ \text{r}\mathbf{3}\ \text{r}\mathbf{4}\ \text{r}\mathbf{5}\ 0\ 0\ 0) \tag{24}$$

$$G_{565}=\text{Gtable_}\mathbf{565}[\text{Index}]=(0\ g\mathbf{1}\ g\mathbf{2}\ g\mathbf{3}\ g\mathbf{4}\ g\mathbf{5}\ g60) \quad (25)$$

$$B_{565}=\text{Btable_}\mathbf{565}[\text{Index}]=(0\ 0\ 0\ b\mathbf{1}\ b\mathbf{2}\ b\mathbf{3}\ b\mathbf{4}\ b\mathbf{5}) \quad (26)$$

In order to combine these components into the two-byte word format for the RGB565 format of Equation (1), the RGB components may be manipulated by executing the exact same compiled computer program code as described earlier in steps (a) through (d) for the RGB664 case. For RGB565 data, the status of the two-byte register after each of steps (a) through (d) is shown as follows:

| | | | | | | | | | | | | | | | | | |
|---|---|---|---|---|---|---|---|---|---|---|---|---|---|---|---|---|---|
| Step (a): | ( | 0 | 0 | 0 | 0 | 0 | 0 | 0 | 0 | 0 | g1 | g2 | g3 | g4 | g5 | g6 | 0 ) |
| Step (b): | ( | 0 | 0 | 0 | 0 | 0 | g1 | g2 | g3 | g4 | g5 | g6 | 0 | 0 | 0 | 0 | 0 ) |
| Step (c): | ( | r1 | r2 | r3 | r4 | r5 | g1 | g2 | g3 | g4 | g5 | g6 | 0 | 0 | 0 | 0 | 0 ) |
| Step (d): | ( | r1 | r2 | r3 | r4 | r5 | g1 | g2 | g3 | g4 | g5 | g6 | b1 | b2 | b3 | b4 | b5 ) |

When RGB555 is the selected RGB16 color format, yet another set of lookup tables is preferably used which return 8-bit byte data for the RGB555 components $R_{555}$, $G_{555}$, and $B_{555}$ according to the following bit patterns:

$$R_{555}=\text{Rtable_}\mathbf{555}[\text{Index}]=(0\ r\mathbf{1}\ r\mathbf{2}\ r\mathbf{3}\ r\mathbf{4}\ r\mathbf{5}\ 0\ 0) \quad (27)$$

$$G_{555}=\text{Gtable_}\mathbf{555}[\text{Index}]=(0\ 0\ g\mathbf{1}\ g\mathbf{2}\ g\mathbf{3}\ g\mathbf{4}\ g\mathbf{5}\ 0) \quad (28)$$

$$B_{555}=\text{Btable_}\mathbf{555}[\text{Index}]=(0\ 0\ 0\ b\mathbf{1}\ b\mathbf{2}\ b\mathbf{3}\ b\mathbf{4}\ b\mathbf{5}) \quad (29)$$

As with the RGB565 case, in order to combine these components into the two-byte word format for the RGB555 format of Equation (3), the RGB components may be manipulated by executing the exact same compiled computer program code as described earlier in steps (a) through (d) for the RGB664 case. For RGB555 data, the status of the two-byte register after each of steps (a) through (d) is shown as follows:

| | | | | | | | | | | | | | | | | | |
|---|---|---|---|---|---|---|---|---|---|---|---|---|---|---|---|---|---|
| Step (a): | ( | 0 | 0 | 0 | 0 | 0 | 0 | 0 | 0 | 0 | 0 | g1 | g2 | g3 | g4 | g5 | 0 ) |
| Step (b): | ( | 0 | 0 | 0 | 0 | 0 | g1 | g2 | g3 | g4 | g5 | 0 | 0 | 0 | 0 | 0 | 0 ) |
| Step (c): | ( | r1 | r2 | r3 | r4 | r5 | g1 | g2 | g3 | g4 | g5 | 0 | 0 | 0 | 0 | 0 | 0 ) |
| Step (d): | ( | r1 | r2 | r3 | r4 | r5 | g1 | g2 | g3 | g4 | g5 | b1 | b2 | b3 | b4 | b5 | 0 ) |

The LSB of the two-byte format for RGB555 is then available for use as an alpha channel.

According to a preferred embodiment, the present invention is implemented in software running on a general-purpose processor. By designing a different set of lookup tables for each different supported RGB16 6 format, the same compiled computer software code can be executed for any of the RGB16 formats. The only difference is the configuration of the lookup tables Rtable, Gtable, and Btable, which can be initialized during run-time processing once for each selection of a different RGB16 format. Moreover, the selection of RGB16 format can change during run-time processing without having to change the executable code; only the lookup tables need to be reconfigured.

As such, the present invention provides a relatively short set-up time to switch from one RGB16 color format to the another RGB16 color format, as opposed to other implementations that would have to load a whole new executable code during run-time processing. The present invention also provides a smaller executable code than other implementations that explicitly support different RGB16 color formats, for example, with a case statement with explicit code for each different RGB16 color format.

Figure 3:
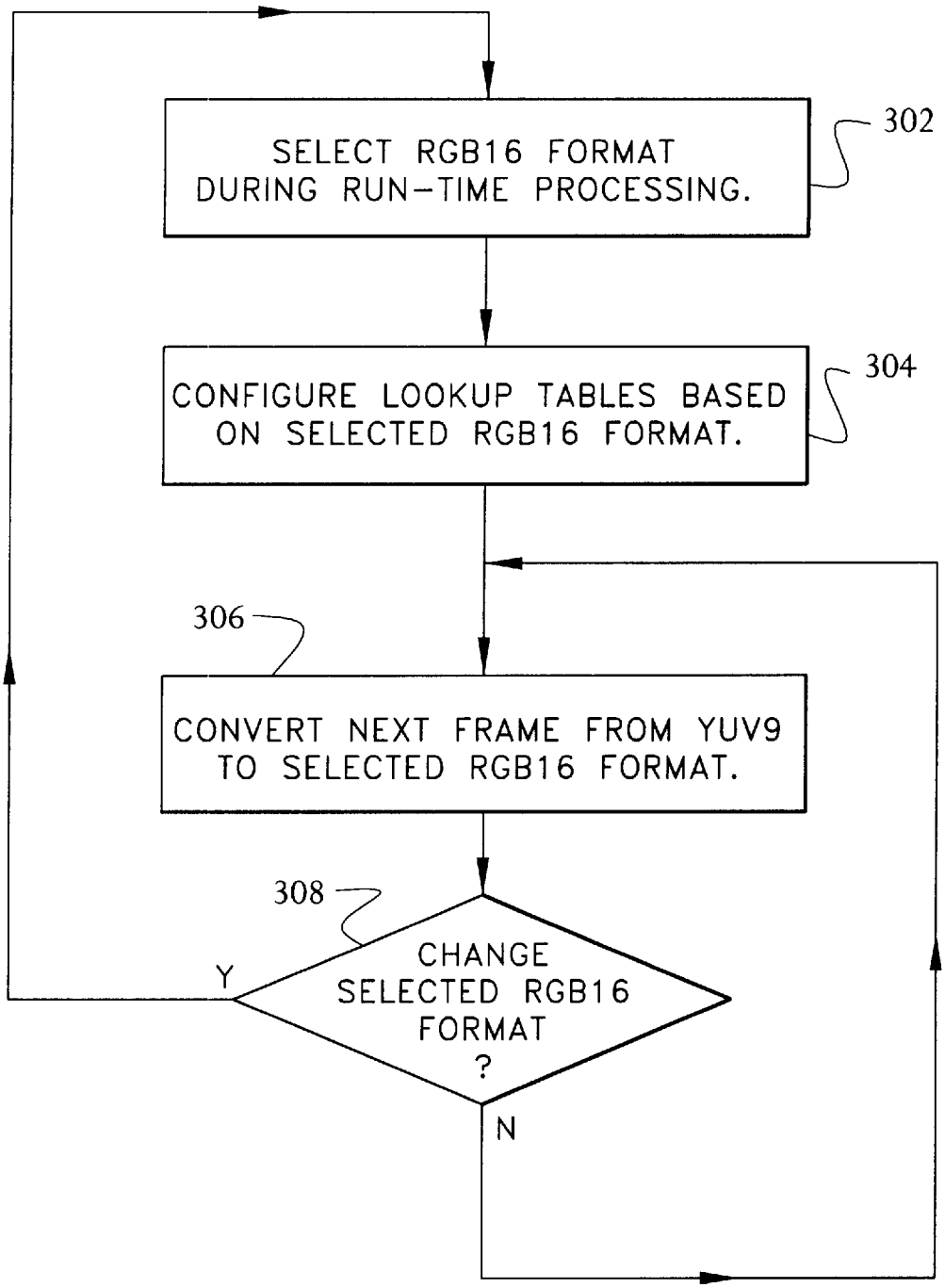
FIG. 3 is a flow diagram of the color conversion processing for a sequence of video images, according to a preferred embodiment of the present invention.

Referring now to FIG. 3, there is shown a flow diagram of the color conversion processing for a sequence of video images, according to a preferred embodiment of the present invention. According to this embodiment, image data is converted from the subsampled YUV9 color format to a specified RGB16 color format, where the specification of RGB16 color format can change from frame to frame.

In particular, after one of the supported RGB16 color formats is selected at during run-time processing (step 302 of FIG. 3), the lookup tables Rtable, Gtable, and Btable are configured (i.e., initialized) based on that selection (step 304). One or more video frames are then converted from subsampled YUV9 color format to the selected RGB16 color format (step 306). This color conversion of video frames continues until and if the selected RGB16 color format is to be changed (step 308), in which case processing returns to steps 302 and 304 to select a new RGB16 color format and reconfigure the lookup tables accordingly for color conversion of additional video frames into the newly selected RGB16 color format.

Figure 4:
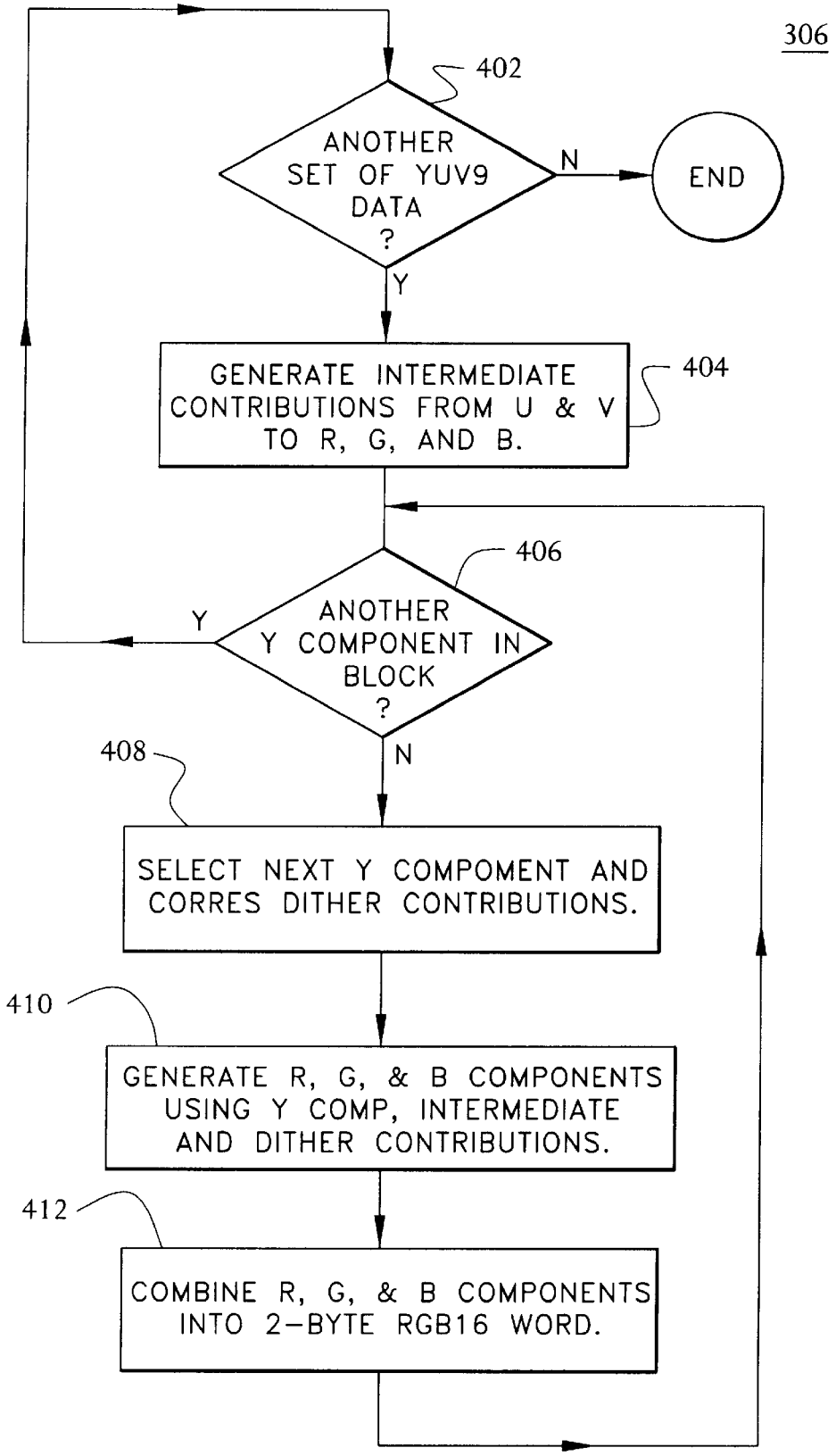
FIG. 4 is a flow diagram of the color conversion processing for each video frame, according to a preferred embodiment of the present invention.

Referring now to FIG. 4, there is shown a flow diagram of the color conversion processing for each video frame of subsampled YUV9 data (step 306 of FIG. 3), according to a preferred embodiment of the present invention. The processing of FIG. 4 is designed to take advantage of the fact that there are one U component and one V component for every (4×4) block of Y components in YUV9 data. It does so by implementing certain operations outside of the loop that processes the 16 different Y components per block.

In particular, if there is another set of YUV9 data in the frame to be converted (step 402 of FIG. 4), then the intermediate contributions from the U and V components to the R, G, and B components (i.e., RV, GU, GV, and BU) are generated once for the current (4×4) block of Y components, based on lookup table operations as shown in Equations (14)–(17) (step 404).

As long as there is another Y component in the current (4×4) block (step 406), the next Y component and the corresponding dither contributions $d_r$, $d_g$, and $d_b$ are selected (step 408) and used along with the intermediate contributions RV, GU, GV and BU to generate the R, G, and B components based on lookup table operations as shown in Equations (18)–(20) (step 410). The resulting R, G, and B components are then combined into the appropriate two-byte word format using steps (a) through (d) as described earlier in this specification for the RGB664 case (step 412).

In a preferred embodiment, the selection of the dither contributions $d_r$, $d_g$, and $d_b$ is based on three (4×4) dither matrices $D_R$, $D_G$, and $D_B$ defined according to Equations (30)–(32) as follows:

$$D_R = \begin{bmatrix} -2 & 4 & 0 & 2 \\ 2 & 0 & 4 & -2 \\ 4 & -2 & 2 & 0 \\ 0 & 2 & -2 & 4 \end{bmatrix} \quad (30)$$

$$D_G = \begin{bmatrix} -2 & 5 & -1 & 4 \\ 1 & 2 & 4 & -1 \\ 5 & -2 & 4 & -1 \\ 2 & 1 & -1 & 4 \end{bmatrix} \quad (31)$$

$$D_B = \begin{bmatrix} -1 & 3 & -1 & 3 \\ 0 & 2 & 2 & 0 \\ 3 & -1 & 3 & -1 \\ 2 & 0 & 0 & 2 \end{bmatrix} \quad (32)$$

In a preferred embodiment, the dither contributions are selected as those matrix elements corresponding to (i.e., having the same relative location as) the current Y component within the (4×4) block.

Figure 5:
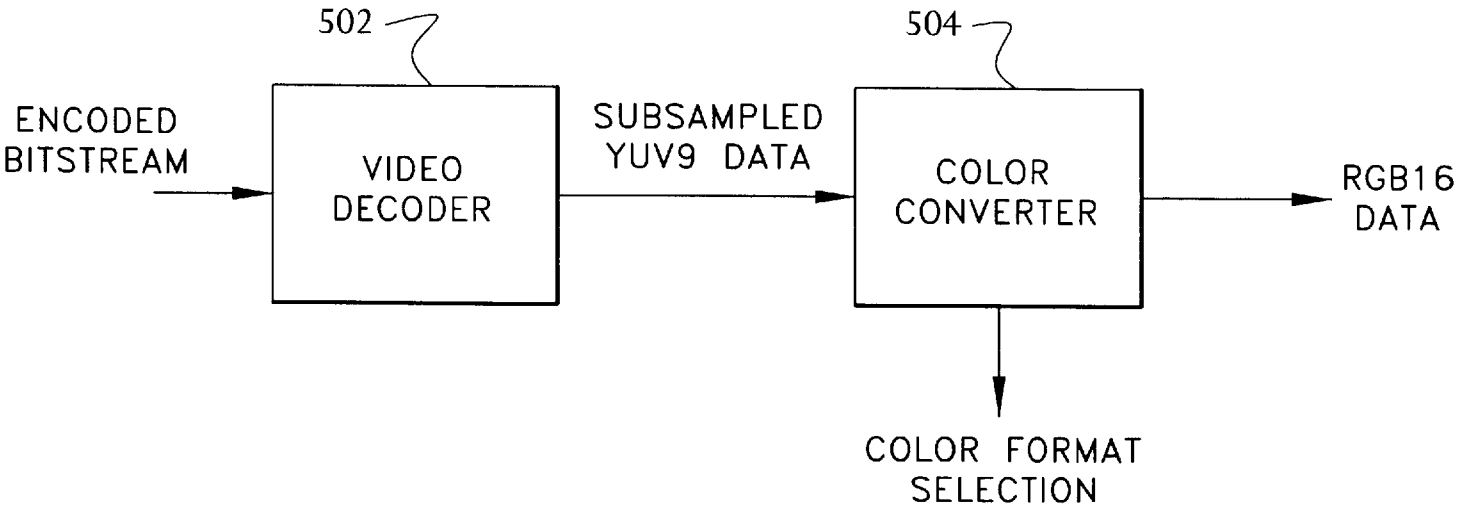
FIG. 5 is a block diagram of the host processor of the decoding system of FIG. 2, according to a preferred embodiment of the present invention.

Referring now to FIG. 5, there is shown a block diagram of host processor 208 of decoding system 200 of FIG. 2, according to a preferred embodiment of the present invention. Video decoder 502 receives an encoded bitstream, decodes the bitstream, and generates decoded image data in a subsampled YUV9 color format. Color converter 504 color converts the YUV9 data into RGB16 data based on a selected RGB16 color format. In this embodiment of the present invention, video decoder 502 functions as the source of image data for color converter 504 to convert. In alternative embodiments, the source of image data for color conversion nay be other than a video decoder. For example, the source of image data for color conversion under the present invention may be a graphics data generator, a camera generating still images, or any other suitable source of image data that is to be color converted into an RGB16 color format.

In embodiments of the present invention based on Equations (18)–(20), dithering is achieved by adding dither contributions to the indices for a single set of R, G, and B lookup tables (for a selected RGB16 color format). In alternative embodiments, two or more sets of R, G, and B lookup tables may be used (for a single selected RGB16 color format) to achieve dithering, where each set of R, G, and B tables has dithering built in to the lookup tables ahead of time. These latter embodiments tend to use more memory than the former embodiments (because they have more tables), but (depending on the processor) may provide faster implementation (because they don't rely on the addition of dither contributions to generate the table indices).

The present invention was described in the context of color converting image data from subsamnpled YUV9 color format to a selected RGB16 color format. The present invention also covers input data in other color formats, including other subsampled YUV color formats (e.g., YUV12 or YUV16), full-sampled YUV color format (e.g., YUV24), and, in general, image data represented in other suitable three-component color spaces, such as YIQ and the like.

Furthermore, the present invention was described in the context of color converting sequences of video frames. Those skilled in the art will understand that the present invention also covers situations in which images other than video frames are color converted, including for example one or more graphics and/or still images.

The present invention can be embodied in the form of methods and apparatuses for practicing those methods. The present invention can also be embodied in the form of computer program code embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments combine with the microprocessor to provide a unique device that operates analogous to specific logic circuits.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A method for color converting image data, comprising the steps of:

(a) providing image data in an initial color format;

(b) selecting any one of two or more respectively different RGB16 formats;

(c) initializing lookup tables during run time processing, with lookup table data corresponding to the selected RGB16 format; and (d) executing compiled computer program code that converts the image data from the initial color format into the selected format, wherein the same compiled computer program code converts the image data from the initial color format into any of the two or more different RGB16 formats, by varying only the lookup table data between respectively different RGB16 formats.

2. The method of claim 1, wherein the two or more different RGB16 formats comprises two or more of RGB655, RGB565, RGB556, RGB664, RGB646, RGB466, and RGB555 color formats.

3. The method of claim 1, wherein the initial color format is a subsampled YUV format, further comprising the steps of:

determining intermediate contributions from the U and V components, using the lookup tables without performing multiplication operations; and determining the R, G and B components using the intermediate contributions and the lookup tables without performing multiplication operations.

4. The method of claim 1, wherein:

the initial color format is a YUV format;

wherein step (d) comprises the steps of:

determining a first intermediate contribution from the V component to an R component based on a first lookup table without performing multiplication operations;

determining a second intermediate contribution from the V component to a G component based on a second lookup table without performing multiplication operations;

determining a third intermediate contribution from the U component to the G component based on a third lookup table without performing multiplication operations;

determining a fourth intermediate contribution from the U component to a B component based on a fourth lookup table without performing multiplication operations;

determining the R component of the RGB16 image data based on a fifth lookup table and the first intermediate contribution without performing multiplication operations;

determining the G component of the RGB16 image data based on a sixth lookup table and the second and third intermediate contributions without performing multiplication operations; and determining the B component of the RGB16 image data based on a first lookup table and the fourth intermediate contribution without performing multiplication operations.

5. The method of claim 4, wherein dither terms are added to indices for the fifth, sixth, and seventh lookup tables.

6. The method of claim 4, wherein the fifth, sixth, and seventh lookup tables are designed to provide correct spacing for combining the R, B, and G components into a 16-bit field for the selected RGB16 format.

7. The method of claim 4, wherein the selection of RGB16 format can be changed during run-time processing, in which case the fifth, sixth, and seventh lookup tables are reinitialized for the newly selected RGB16 format.

8. The method of claim 4, wherein the initial color format is a subsampled YUV9 format.

9. The method of claim 8, wherein:

dither terms are added to indices for the fifth, sixth, and seventh lookup tables;

the fifth, sixth, and seventh lookup tables are designed to provide correct spacing for combining the R, B, and G components into a 16-bit field for the selected RGB16 format; and the selection of RGB16 format can be changed during run-time processing, in which case the fifth, sixth, and seventh lookup tables are reinitialized for the newly selected RGB16 format.

10. A method according to claim 1, further comprising the step of converting image data to a second one of the two or more RGB16 formats without executing different computer program code than is executed when converting the image data to the first one of the RGB16 formats.

11. An apparatus for color converting image data, comprising:

(a) means for providing image data in an initial color format;

(b) means for selecting any one of two or more respectively different RGB16 formats;

(c) means for initializing lookup tables during run time processing, with lookup table data corresponding to the selected RGB16 format; and (d) means for executing compiled computer program code that converts the image data from the initial color format into the selected format, wherein the same compiled computer program code converts the image data from the initial color format into any of the two or more different RGB16 formats, by varying only the lookup table data between respectively different RGB16 formats.

12. The apparatus of claim 11, wherein the two or more different RGB16 formats comprises two or more of RGB655, RGB565, RGB556, RGB664, RGB646, RGB466, and RGB555 color formats.

13. The apparatus of claim 11, wherein the initial color format is a subsampled YUV format, further comprising:

means for determining intermediate contributions from the U and V components, using the lookup tables without performing multiplication operations; and means for determining the R, G and B components using the intermediate contributions and the lookup tables without performing multiplication operations.

14. The apparatus of claim 11, wherein the initial color format is a YUV format, the apparatus further comprising a first lookup table, which maps each V component of the YUV image data to a first intermediate contribution from the V component to a G component without performing multiplication operations;

a second lookup table, which maps each V component of the YUV image data to a second intermediate contribution from the V component to a G component without performing multiplication operations;

a third lookup table, which maps each U component of the YUV image data to a third intermediate contribution from the U component to the G component without performing multiplication operations;

a fourth lookup table, which maps each U component of the YUV image data to a fourth intermediate contribution from the U component to a B component without performing multiplication operations;

a fifth lookup table, which maps each Y component and its corresponding first intermediate contribution to an R component of the RGB16 image data without performing multiplication operations;

a sixth lookup table, which maps each Y component and its corresponding second and third intermediate contribution to a G component of the RGB16 image data without performing multiplication operations; and a seventh lookup, which table maps each Y component and its corresponding fourth intermediate contribution to a B component of the RGB16 image data without performing multiplication operations.

15. The apparatus of claim 14, wherein dither terms are added to indices for the fifth, sixth, and seventh lookup tables.

16. The apparatus of claim 14, wherein the fifth, sixth, and seventh lookup tables are designed to provide correct spacing for combining the R, B, and G components into a 16-bit field for the selected RGB16 format.

17. The apparatus of claim 14, wherein the selection of RGB16 format can be changed during run-time processing, in which case the fifth, sixth, and seventh lookup tables are reinitialized for the newly selected RGB16 format.

18. The apparatus of claim 14, wherein the initial color format is a subsampled YUV9 format.

19. The apparatus of claim 18, wherein:

dither terms are added to indices for the fifth, sixth, and seventh lookup tables;

the fifth, sixth, and seventh lookup tables are designed to provide correct spacing for combining the R, B, and G components into a 16-bit field for the selected RGB16 format; and the selection of RGB16 format can be changed during run-time processing, in which case the fifth, sixth, and seventh lookup tables are reinitialized for the newly selected RGB16 format.

20. Apparatus according to claim 11, wherein the executing means converts image data to a second one of the two or more RGB16 formats without executing different computer program code than is executed when converting the image data to the first one of the RGB16 formats.

21. A storage medium encoded with machine-readable computer program code for color converting image data, comprising:

(a) means for causing a computer to provide image data in an initial color format;

(b) means for causing the computer to select any one of two or more respectively different RGB16 formats;

(c) means for causing the computer to initialize lookup tables during run time processing, with lookup table data corresponding to the selected RGB16 format; and (d) means for causing the computer to execute compiled computer program code that converts the image data from the initial color format into the selected format, wherein the same compiled computer program code converts the image data from the initial color format into any of the two or more different RGB16 formats, by varying only the lookup table data between respectively different RGB16 formats.

22. The storage medium of claim 21, wherein the two or more different RGB16 formats comprises two or more of RGB655, RGB565, RGB556, RGB664, RGB646, RGB466, and RGB555 color formats.

23. The storage medium of claim 21, wherein the initial color format is a subsampled YUV format, further comprising:

means for causing the computer to determine intermediate contributions from the U and V components, using the lookup tables without performing multiplication operations; and means for causing the computer to determine the R, G and B components using the intermediate contributions and the lookup tables without performing multiplication operations.

24. The storage medium of claim 21, wherein the initial color format is a YUV format further comprising:

means for causing the computer to use a first lookup table to map each V component of the YUV image data to a first intermediate contribution from the V component to an R component without performing multiplication operations;

means for causing the computer to use a second lookup table to map each V component of the YUV image data to a second intermediate contribution from the V component to a G component without performing multiplication operations;

means for causing the computer to use a third lookup table to map each U component of the YUV image data to a third intermediate contribution from the U component to the G component without performing multiplication operations;

means for causing the computer to use a fourth lookup table to map each U component of the YUV image data to a fourth intermediate contribution from the U component to a B component without performing multiplication operations;

means for causing the computer to use a fifth lookup table to map each Y component and its corresponding first intermediate contribution to an R component of the RGB16 image data without performing multiplication operations;

means for causing the computer to use a sixth lookup table to map each Y component and its corresponding second and third intermediate contribution to a G component of the RGB16 image data without performing multiplication operations; and means for causing the computer to use a seventh lookup table to map each Y component and its corresponding fourth intermediate contribution to a B component of the RGB16 image data without performing multiplication operations.

25. The storage medium of claim 24, wherein dither terms are added to indices for the fifth, sixth, and seventh lookup tables.

26. The storage medium of claim 24, wherein the fifth, sixth, and seventh lookup tables are designed to provide correct spacing for combining the R, B, and G components into a 16-bit field for the selected RGB16 format.

27. The storage medium of claim 24, wherein the selection of RGB16 format can be changed during run-time processing, in which case the fifth, sixth, and seventh lookup tables are reinitialized for the newly selected RGB16 format.

28. The storage medium of claim 24, wherein the initial color format is a subsampled YUV9 format.

29. The storage medium of claim 28, wherein:

dither terms are added to indices for the fifth, sixth, and seventh lookup tables;

the fifth, sixth, and seventh lookup tables are designed to provide correct spacing for combining the R, B, and G components into a 16-bit field for the selected RGB16 format; and the selection of RGB16 format can be changed during run-time processing, in which case the fifth, sixth, and seventh lookup tables are reinitialized for the newly selected RGB16 format.

30. Apparatus according to claim 21, wherein means (d) causes the computer to convert image data to a second one of the two or more RGB16 formats without executing different computer program code than is executed when converting the image data to the first one of the RGB16 formats.

31. An apparatus for color converting image data, comprising:

(a) an image data generator; and (b) a color converter having lookup tables, wherein:

(1) the image data generator provides image data in an initial color format;

(2) any one of two or more respectively different RGB16 formats is selected;

(3) the lookup tables of the color converter are initialized during run time processing, with lookup table data corresponding to the selected RGB16 format; and (4) the color converter executes compiled computer program code that converts the image data from the initial color format into the selected format, wherein the same compiled computer program code converts the image data from the initial color format into any of the two or more different RGB16 formats, by varying only the lookup table data between respectively different RGB16 formats.

32. The apparatus of claim 31, wherein the two or more different RGB16 formats comprises two or more of RGB655, RGB565, RGB556, RGB664, RGB646, RGB466, and RGB555 color formats.

33. The apparatus of claim 31, wherein the initial color format is a subsampled YUV format, wherein:

the color converter determines intermediate contributions from the U and V components, using the lookup tables without performing multiplication operations; and the color converter determines the R, G and B components using the intermediate contributions and the lookup tables without performing multiplication operations.

34. The apparatus of claim 31, wherein the initial color format is a YUV format, and the color converter has:

a first lookup table, which maps each V component of the YUV image data to a first intermediate contribution from the V component to an R component without performing multiplication operations;

a second lookup table, which maps each V component of the YUV image data to a second intermediate contribution from the V component to a G component without performing multiplication operations;

a third lookup table, which maps each U component of the YUV image data to a third intermediate contribution from the U component to the G component without performing multiplication operations;

a fourth lookup table, which maps each U component of the YUV image data to a fourth intermediate contribution from the U component to a B component without performing multiplication operations;

a fifth lookup table, which maps each Y component and its corresponding first intermediate contribution to an R component of the RGB16 image data without performing multiplication operations;

a sixth lookup table, which maps each Y component and its corresponding second and third intermediate contributions to a G component of the RGB16 image data without performing multiplication operations; and a seventh lookup table, which maps each Y component and its corresponding fourth intermediate contribution to a B component of the RGB16 image data without performing multiplication operations.

35. The apparatus of claim 34, wherein dither terms are added to indices for the fifth, sixth, and seventh lookup tables.

36. The apparatus of claim 34, wherein the fifth, sixth, and seventh lookup tables are designed to provide correct spacing for combining the R, B, and G components into a 16-bit field for the selected RGB16 format.

37. The apparatus of claim 34, wherein the selection of RGB16 format can be changed during run-time processing, in which case the fifth, sixth, and seventh lookup tables are reinitialized for the newly selected RGB16 format.

38. The apparatus of claim 34, wherein the initial color format is a subsampled YUV9 format.

39. The apparatus of claim 38, wherein:

dither terms are added to indices for the fifth, sixth, and seventh lookup tables;

the fifth, sixth, and seventh lookup tables are designed to provide correct spacing for combining the R, B, and G components into a 16-bit field for the selected RGB16 format; and the selection of RGB16 format can be changed during run-time processing, in which case the fifth, sixth, and seventh lookup tables are reinitialized for the newly selected RGB16 format.

40. Apparatus according to claim 31, wherein the color converter converts image data to a second one of the two or more RGB16 formats without executing different computer program code than is executed when converting the image data to the first one of the RGB16 formats.

* * * * *